US009238294B2

(12) United States Patent
Lefevre et al.

(10) Patent No.: US 9,238,294 B2
(45) Date of Patent: Jan. 19, 2016

(54) POLISHING PAD HAVING POROGENS WITH LIQUID FILLER

(71) Applicants: Paul Andre Lefevre, Portland, OR (US); William C. Allison, Beaverton, OR (US)

(72) Inventors: Paul Andre Lefevre, Portland, OR (US); William C. Allison, Beaverton, OR (US)

(73) Assignee: NexPlanar Corporation, Hillsboro, OR (US)

( * ) Notice: Subject to any disclaimer, the term of this patent is extended or adjusted under 35 U.S.C. 154(b) by 17 days.

(21) Appl. No.: 14/307,846

(22) Filed: Jun. 18, 2014

(65) Prior Publication Data

US 2015/0367478 A1 Dec. 24, 2015

(51) Int. Cl.

| | |
|---|---|
| ***B24B 37/20*** | (2012.01) |
| ***B24B 37/24*** | (2012.01) |
| ***B24B 37/26*** | (2012.01) |
| ***B24D 3/32*** | (2006.01) |

(52) U.S. Cl.

CPC ..... *B24B 37/24* (2013.01); *B24B 37/205* (2013.01); *B24B 37/26* (2013.01); *B24D 3/32* (2013.01)

(58) Field of Classification Search

CPC ..... B24B 37/24; B24B 37/005; B24B 37/26; B24D 3/32; B24D 3/18; B24D 18/00; B29C 44/06; B29C 67/202; B01D 67/003; C08J 9/26

USPC ..... 451/56, 526–539; 51/296; 264/49

See application file for complete search history.

(56) References Cited

U.S. PATENT DOCUMENTS

| | | | | | |
|---|---|---|---|---|---|
| 2,375,263 | A * | 5/1945 | Upper | B24D 13/02 | 156/250 |
| 3,922,801 | A * | 12/1975 | Zente | A43B 13/20 | 36/44 |
| 3,962,154 | A * | 6/1976 | Egli | B29C 44/42 | 264/48 |
| 5,147,937 | A * | 9/1992 | Frazza | C08F 257/02 | 521/117 |
| 5,534,023 | A * | 7/1996 | Henley | A61F 2/12 | 623/7 |
| 5,976,000 | A * | 11/1999 | Hudson | B24B 37/24 | 451/526 |
| 6,126,532 | A * | 10/2000 | Sevilla | B24B 37/22 | 451/526 |
| 6,231,942 | B1 * | 5/2001 | Blizard | A47G 21/18 | 239/33 |
| 6,239,188 | B1 | 5/2001 | Kihara et al. | | |
| 6,531,523 | B1 * | 3/2003 | Davankov | B01J 20/26 | 521/65 |

(Continued)

FOREIGN PATENT DOCUMENTS

| | | |
|---|---|---|
| JP | 11-322877 | 11/1999 |
| JP | 2000-344902 | 12/2000 |
| JP | 2008-168416 | 7/2008 |

*Primary Examiner* — George Nguyen

(74) *Attorney, Agent, or Firm* — Blakely Sokoloff Taylor Zafman LLP

(57) ABSTRACT

Polishing pads having porogens with liquid filler and methods of fabricating polishing pads having porogens with liquid filler are described. In an example, a polishing pad for polishing a substrate includes a polishing body having a polymer matrix and a plurality of porogens dispersed throughout the polymer matrix. Each of the plurality of porogens has a shell with a liquid filler. The liquid filler has a boiling point less than 100 degrees Celsius at a pressure of 1 atm, a density less than water, or both.

65 Claims, 8 Drawing Sheets

(56) References Cited

U.S. PATENT DOCUMENTS 6,537,134 B2 * 3/2003 Newell ..... B24B 49/12 451/41
7,435,364 B2 10/2008 James et al.
7,976,901 B2 * 7/2011 Kume ..... B24D 3/32 427/341
8,075,372 B2 * 12/2011 Prasad ..... B24B 37/26 451/527
2002/0038530 A1 * 4/2002 Clark ..... E04D 1/24 52/171.3
2003/0220061 A1 * 11/2003 Prasad ..... B24D 3/32 451/526
2005/0042976 A1 * 2/2005 Ronay ..... B24B 37/24 451/41
2005/0087487 A1 * 4/2005 Sakamoto ..... B01D 67/002 210/500.36
2005/0215177 A1 * 9/2005 Prasad ..... B24B 37/241 451/5
2006/0276109 A1 * 12/2006 Roy ..... B24B 37/042 451/41
2007/0042693 A1 2/2007 Saikin
2007/0212985 A1 * 9/2007 Boler ..... B24D 15/04 451/28
2008/0057844 A1 * 3/2008 Miekka ..... B24D 15/02 451/526
2009/0320379 A1 * 12/2009 Jun ..... B24D 3/32 51/298
2010/0247868 A1 * 9/2010 Cha ..... B24B 37/24 428/160
2011/0276133 A1 * 11/2011 Liu ..... A61L 27/34 623/8
2012/0009855 A1 * 1/2012 Allison ..... B24B 37/205 451/527
2012/0094586 A1 * 4/2012 Huang ..... B24B 37/26 451/527
2012/0279138 A1 11/2012 Fukuda et al.
2012/0302148 A1 * 11/2012 Bajaj ..... B24B 37/205 451/527
2013/0017764 A1 * 1/2013 Allison ..... B24B 37/205 451/6
2013/0137349 A1 * 5/2013 Lefevre ..... B24B 37/16 451/526
2013/0324020 A1 * 12/2013 Lefevre ..... B24B 37/205 451/529
2014/0242894 A1 * 8/2014 Itoyama ..... B24B 37/24 451/548

* cited by examiner

300

300

POLISHING PAD HAVING POROGENS WITH LIQUID FILLER

TECHNICAL FIELD

Embodiments of the present invention are in the field of chemical mechanical polishing (CMP) and, in particular, polishing pads having porogens with liquid filler and methods of fabricating polishing pads having porogens with liquid filler.

BACKGROUND

Chemical-mechanical planarization or chemical-mechanical polishing, commonly abbreviated CMP, is a technique used in semiconductor fabrication for planarizing a semiconductor wafer or other substrate.

The process involves use of an abrasive and corrosive chemical slurry (commonly a colloid) in conjunction with a polishing pad and retaining ring, typically of a greater diameter than the wafer. The polishing pad and wafer are pressed together by a dynamic polishing head and held in place by a plastic retaining ring. The dynamic polishing head is rotated during polishing. This approach aids in removal of material and tends to even out any irregular topography, making the wafer flat or planar. This may be necessary in order to set up the wafer for the formation of additional circuit elements. For example, this might be necessary in order to bring the entire surface within the depth of field of a photolithography system, or to selectively remove material based on its position. Typical depth-of-field requirements are down to Angstrom levels for the latest sub-50 nanometer technology nodes.

The process of material removal is not simply that of abrasive scraping, like sandpaper on wood. The chemicals in the slurry also react with and/or weaken the material to be removed. The abrasive accelerates this weakening process and the polishing pad helps to wipe the reacted materials from the surface. In addition to advances in slurry technology, the polishing pad plays a significant role in increasingly complex CMP operations.

However, additional improvements are needed in the evolution of CMP pad technology.

SUMMARY

Embodiments of the present invention include polishing pads having porogens with liquid filler and methods of fabricating polishing pads having porogens with liquid filler.

In an embodiment, a polishing pad for polishing a substrate includes a polishing body having a polymer matrix and a plurality of porogens dispersed throughout the polymer matrix. Each of the plurality of porogens has a shell with a liquid filler. The liquid filler has a boiling point less than 100 degrees Celsius at a pressure of 1 atm.

In another embodiment, a polishing pad for polishing a substrate includes a polishing body having a polymer matrix and a plurality of porogens dispersed throughout the polymer matrix. Each of the plurality of porogens has a shell with a liquid filler. The liquid filler has a density less than water.

In another embodiment, a method of polishing a substrate involves providing a polishing pad on a platen. The polishing pad includes a plurality of porogens dispersed throughout a polymer matrix of a polishing body of the polishing pad. Each of the plurality of porogens includes a shell with a liquid filler, the liquid filler having a boiling point less than 100 degrees Celsius at a pressure of 1 atm or having a density less than water, or both. The method also involves conditioning the polishing pad. The conditioning involves breaking an uppermost portion of the plurality of porogens of the polishing body of the polishing pad to provide a polishing surface of the polishing pad. The method also involves applying a slurry on the polishing surface of the polishing pad. The method also involves polishing a substrate with the slurry on the polishing surface of the polishing pad.

In another embodiment, a method of fabricating a polishing pad involves mixing a pre-polymer and a curative with a plurality of porogens to form a mixture. Each of the plurality of porogens has a shell with a liquid filler, the liquid filler having a boiling point less than 100 degrees Celsius at a pressure of 1 atm or having a density less than water, or both. The method also involves curing the mixture to provide a polishing pad having a polishing body with the plurality of porogens dispersed throughout a polymer matrix of the polishing body. The curing does not substantially expand each of the plurality of porogens.

DETAILED DESCRIPTION

Figure 1A:
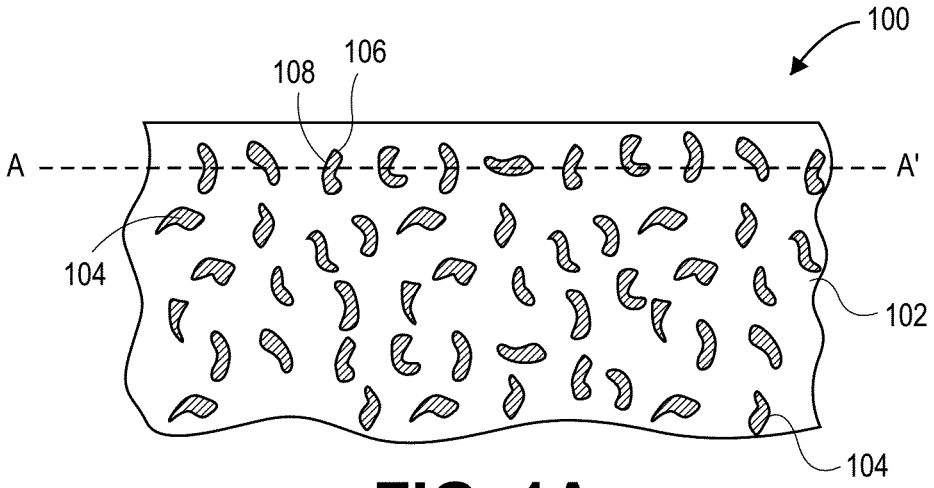
FIG. 1A illustrates a cross-sectional view of a CMP polishing pad having liquid-filled porogens, in accordance with an embodiment of the present invention.

Polishing pads having porogens with liquid filler and methods of fabricating polishing pads having porogens with liquid filler are described herein. In the following description, numerous specific details are set forth, such as specific polishing pad designs and compositions, in order to provide a thorough understanding of embodiments of the present invention. It will be apparent to one skilled in the art that embodiments of the present invention may be practiced without these specific details. In other instances, well-known processing techniques, such as details concerning the combination of a slurry with a polishing pad to perform chemical mechanical planarization (CMP) of a semiconductor substrate, are not described in detail in order to not unnecessarily obscure embodiments of the present invention. Furthermore, it is to be understood that the various embodiments shown in the figures are illustrative representations and are not necessarily drawn to scale.

One or more embodiments described herein are directed to CMP polishing pads having liquid-filled porogens or microelements dispersed throughout the matrix of the polishing pad. In use, at the pad surface, the liquid-filled porogens are broken, e.g., by a pad disk conditioner. The liquid filler is volatilized and/or pushed out by slurry from the broken porogens to provide available pores at the pad surface. The liquid-filled porogens that remain embedded in the pad, below the pad surface, provide for a high density pad bulk that is desirable for planarization performance. At the pad surface, the material is transformed to a low density porous layer that is needed for slurry transport.

To provide context, attempts have been made to incorporate water-soluble particles in a CMP pad. The water-soluble particles would dissolve upon contact with an aqueous slurry. However, the inclusion of such water-soluble material in a CMP pad can result in undesired and or uncontrolled reaction with the slurry chemicals, particularly in cases where the water-soluble material is chemically active. In one embodiment, addressing the above issues, a polyurethane matrix of a CMP polishing pad is fabricated to include liquid-filled porogens, such as unexpanded EXPANCEL™ porogens. The pad manufacturing process is performed at a temperature lower than the EXPANCEL™ expansion temperature. The filler in the EXPANCEL™ porogens or microelements remains in the liquid phase during the pad manufacturing process. The result is a CMP polishing pad which, in use, can be made to have a bulk portion of that is as solid or dense as possible for planarization. Meanwhile, the pad surface can be rendered as soft as possible for defect reduction.

More generally, one or more embodiments described herein are directed to the fabrication of polishing pads having a high bulk density of greater than approximately 0.8 grams/cubic centimeter (g/cc) and, more particularly, a high density of greater than approximately 1 g/cc. The resulting pads may be based on a polyurethane material having a closed cell porosity which provides for the high density.

In an exemplary embodiment, FIG. 1A illustrates a cross-sectional view of a CMP polishing pads having liquid-filled porogens. Referring to FIG. 1A, a polishing pad 100 includes a polishing body including a polymer matrix 102 and a plurality of porogens 104 dispersed throughout the polymer matrix 102. Each of the plurality of porogens 104 includes a shell 106 with a liquid filler 108.

In an embodiment, the liquid filler 108 of the porogens 104 is a filler contained in the shell 106, a majority of which is in the liquid phase. In one such embodiment, for one or more of the porogens 104, the liquid filler 108 completely fills the shell 106 and, as such, is entirely in the liquid phase. However, in another embodiment, for one or more porogens 104, the liquid filler 108 only partially fills the shell 106. In that embodiment, the liquid filler may be in equilibrium with the gas phase of the liquid filler. Nonetheless, a majority (by mass) of the liquid filler 108 is in the liquid phase. It is to be appreciated that the liquid filer 108, as contained in the shell 106, is effectively in a closed system while contained in the body of the polishing pad 100.

In an embodiment, the liquid filler 108 has a boiling point less than that of water, i.e., a boiling point less than 100 degrees Celsius at a pressure of 1 atm. In an embodiment, the liquid filler has a density less than water, i.e., a density less than 1 g/cm$^3$ (as defined for water at 4 degrees Celsius) and, in a particular embodiment, the liquid filler 108 has a density less than approximately 0.7 g/cm$^3$. In one embodiment, the liquid filler 108 is a hydrocarbon such as, but not limited to, n-pentane, iso-pentane, butane, or iso-butane (e.g., hydrocarbons having a boiling point less than 40 degrees Celsius at a pressure of 1 atm). However, in other embodiments, heavier hydrocarbons such as toluene or light mineral may be used. In one such embodiment, the liquid filler 108 is a hydrocarbon molecule having seven or more carbon atoms.

In an embodiment, the shell 106 of each liquid-filled porogen 104 is a polymeric shell. In one such embodiment, the polymeric shell is composed of a material such as, but not limited to, a block-co-polymer, polyvinylidine chloride, an acrylic material, or acrylonitrile. In an embodiment, the liquid-filler 108/shell 106 pairings can be described as an Unexpanded Porogen Filler or Underexpanded Porogen Filler (both referred to as UPF) that would otherwise expand during polishing pad fabrication at some raised temperature. However, the UPF remains a liquid-filled non-expanded porogen if the polishing pad fabrication process is maintained below an expansion temperature, as is described in greater detail below. In one such embodiment, a large quantity of UPF is included in a polyurethane-forming mixture. The UPF does not expand during the pad casting process and creates a high density pad with liquid-filled porogens.

In an embodiment, at least some of the plurality of porogens 104 have a collapsed-sphere shape. That is, the porogens 104 may approximate a shape of a deflated sphere that could otherwise be inflated to a spherical shape. The collapsed-shape may be completely collapsed to provide a crescent-like shape, or may be partially spherical or even mostly spherical.

Figure 2A:
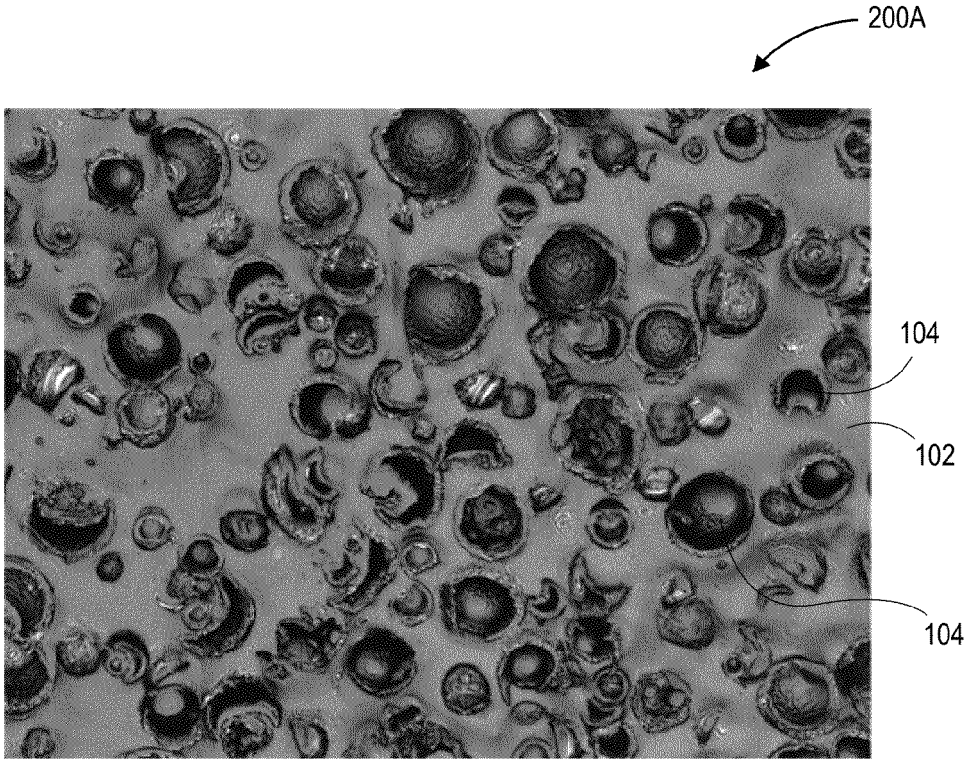
FIG. 2A is a confocal microscope image of a portion of a polishing pad cross-section having liquid-filled porogens in a matrix thereof, in accordance with an embodiment of the present invention.

In an example, FIG. 2A is a confocal microscope image of a portion of a polishing pad 200A cross-section having liquid-filled porogens 104 in a matrix 102 thereof, in accordance with an embodiment of the present invention. Referring to FIG. 2A, in cases where a side-on view of the porogen is seen, a crescent or crescent-like shape is viewed. In cases where a bottom view of the porogen is seen, a round or partial sphere portion is seen.

Figure 2B:
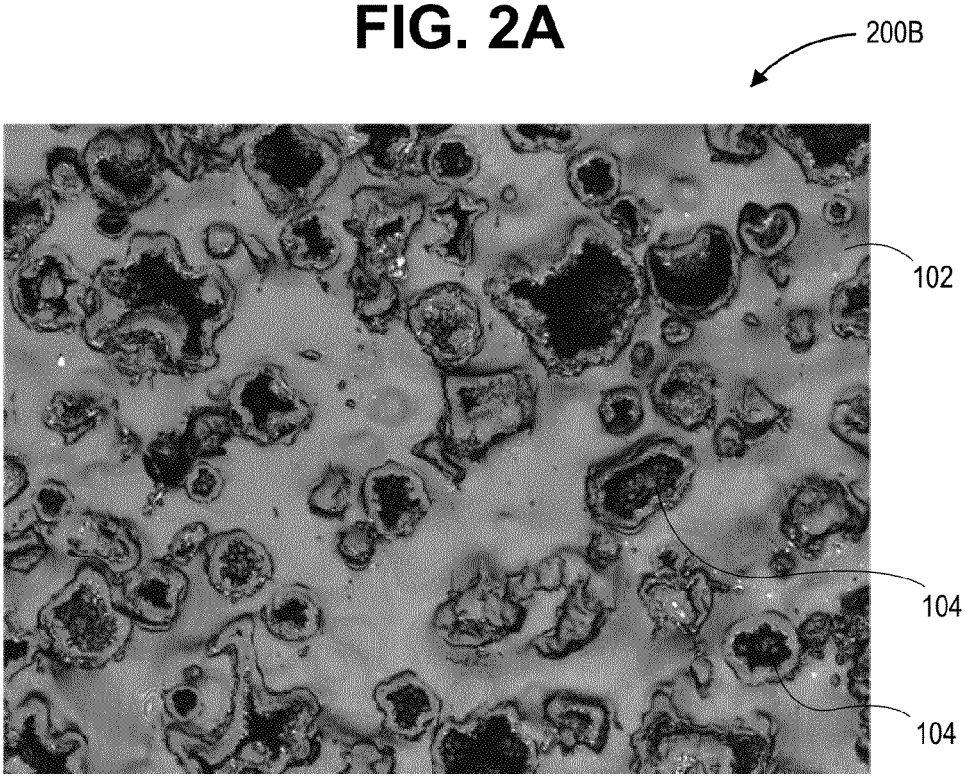
FIG. 2B is a confocal microscope image of a portion of a polishing pad cross-section having liquid-filled porogens in a matrix thereof, in accordance with another embodiment of the present invention.

It is to be appreciated that the liquid-filled porogens may also take on irregular shapes. In an example, FIG. 2B is a confocal microscope image of a portion of a polishing pad 200B cross-section having liquid-filled porogens 104 in a matrix 102 thereof, in accordance with another embodiment of the present invention. Referring to FIG. 2B, the porogens 104 are predominantly non-spherical, with some even having somewhat sharp features.

Regardless of actual shape, the liquid-filled porogens 104 may be described as having an average diameter. Different from a sphere where the diameter is the same in any direction, the liquid-filled porogens 104 can be sized by the average diameter achieved when the size of the porogen is measured in all directions. For example, a crescent-shaped porogen will have a short diameter in the crescent view and a long diameter in the bottom view. An average diameter for the porogen may be described as an average of such diameters. In a particular embodiment, each porogen 104, e.g., a collapsed-sphere shaped porogen, has an average diameter approximately in the range of 6-40 microns.

In an embodiment, the polymer matrix 102 of the polishing body of the polishing pad 100 is or includes a thermoset polyurethane material. In one such embodiment, the polishing body including the polymer matrix 102 and the plurality of porogens 104 has a total volume, with the plurality of porogens contributing approximately 20% to approximately 50% of the total volume. In an embodiment, the polishing body including the polymer matrix 102 and the plurality of porogens 104 has a total density greater than approximately 0.8 g/cm$^3$ and, more particularly, a total density greater than approximately 1 g/cm$^3$. Thus, in some embodiments, the polishing pad 100 is a high density polishing pad since other known polishing pads typically have a density between 0.65 and 0.8 g/cm$^3$.

In another aspect, the polishing pad 100 described in association with FIG. 1A may be used in a chemical mechanical planarizing process used for polishing a substrate. For example, the polishing pad 100 may be placed on a platen upon which a CMP process is performed on and above the polishing pad, as is described in greater detail below in association with FIG. 7.

Figure 1B:
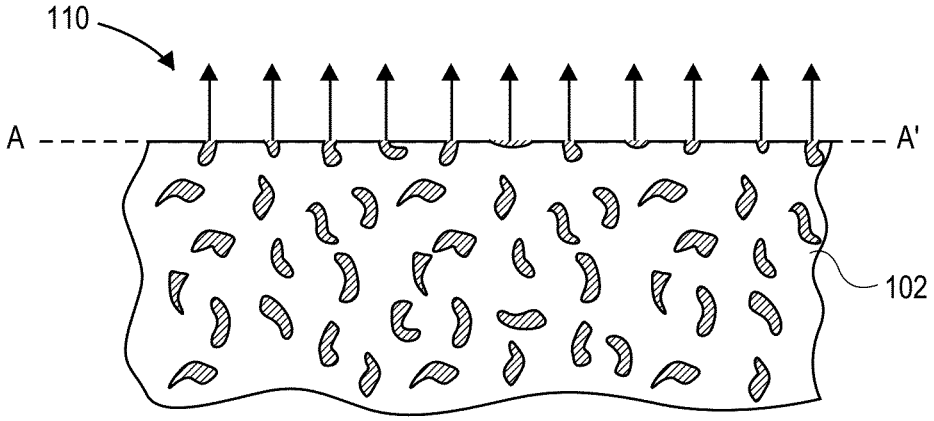
FIG. 1B illustrates a cross-sectional view of the polishing pad of FIG. 1A following conditioning to remove the portion of the polishing pad above the A-A' axis, in accordance with an embodiment of the present invention.

In an embodiment, prior to and/or during the CMP process, the polishing pad 100 is conditioned. Referring to FIG. 1A, the polishing pad 100 may be conditioned to remove the portion of the pad above the A-A' axis. FIG. 1B illustrates a cross-sectional view of the polishing pad of FIG. 1A following conditioning to remove the portion of the polishing pad above the A-A' axis, in accordance with an embodiment of the present invention.

Referring to FIG. 1B, the conditioning involves breaking an uppermost portion of the plurality of porogens 104 to provide a polishing surface 110 of the polishing pad 100. In one such embodiment, the conditioning involves cutting an uppermost portion of the polishing pad with a pad conditioning tool, which may include a diamond cutter.

In an embodiment, breaking the uppermost portion of the plurality of porogens 104 leads to the releasing of the liquid filler of the broken, uppermost portion, of the porogens. In one such embodiment, the liquid filler is released, at least to some extent, by volatilization of the liquid filler upon exposure to ambient conditions outside of the pad. In such cases, a liquid filler having a high vapor pressure can be released in this manner. In another embodiment, at least to some extent, the liquid filler is displaced by a liquid or slurry applied to the surface of the polishing pad. In such cases, a low viscosity liquid filler can be released or displaced in this manner.

Figure 1C:
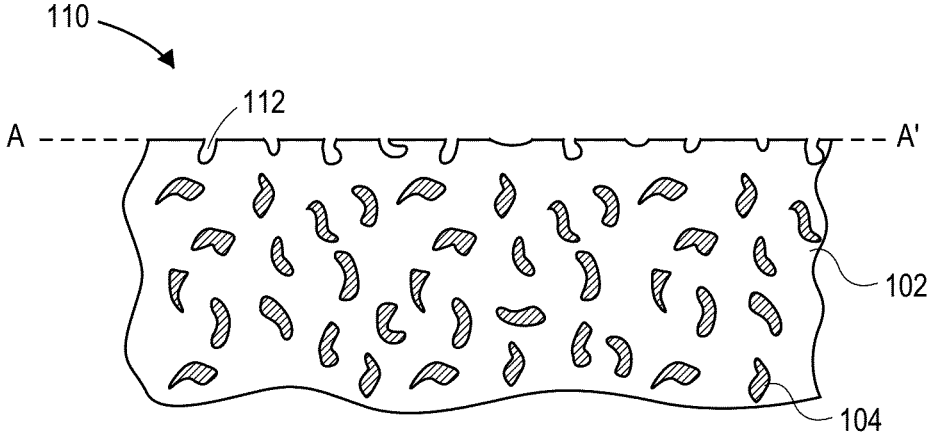
FIG. 1C illustrates a cross-sectional view of the polishing pad of FIG. 1B following release of the liquid filler from the uppermost porogens, in accordance with an embodiment of the present invention.

Referring to FIG. 1C, upon release of the liquid filler, a plurality of open pores 112 is generated at the pad surface 110. The resulting polishing pad may be used in conjunction with a slurry applied thereto for CMP processing of wafers or substrates. The generation of the pores 112 can, in one embodiment, provide an intrinsic ability of the resulting polishing pad to transport slurry. It is to be appreciated that the pad may be conditioned or otherwise cut may times during the life of the polishing pad, each time removing an uppermost layer of the pad and, thus, thinning the polishing pad over time.

In an embodiment, referring again to FIG. 3C, upon release of the liquid filler, the uppermost portion of the pad (essentially the exposed portion) is made to be considerably softer than the bulk portion of the pad with the retained liquid-filled porogens. The conditioning process with the pad 100 enables real time fabrication of a polishing pad having a polishing surface substantially softer than the remainder of the bulk pad below the polishing surface. And, since the bulk portion of the pad has liquid-filled porogens as opposed to gas-filled porogens, the bulk portion of the pad can be made to have very high density. Accordingly, in an embodiment, the breaking the uppermost portion of the plurality of porogens 104 provides the polishing surface 110 having a lower density and lower hardness than a remaining underlying portion of the polishing body of the polishing pad.

Figure 3A:
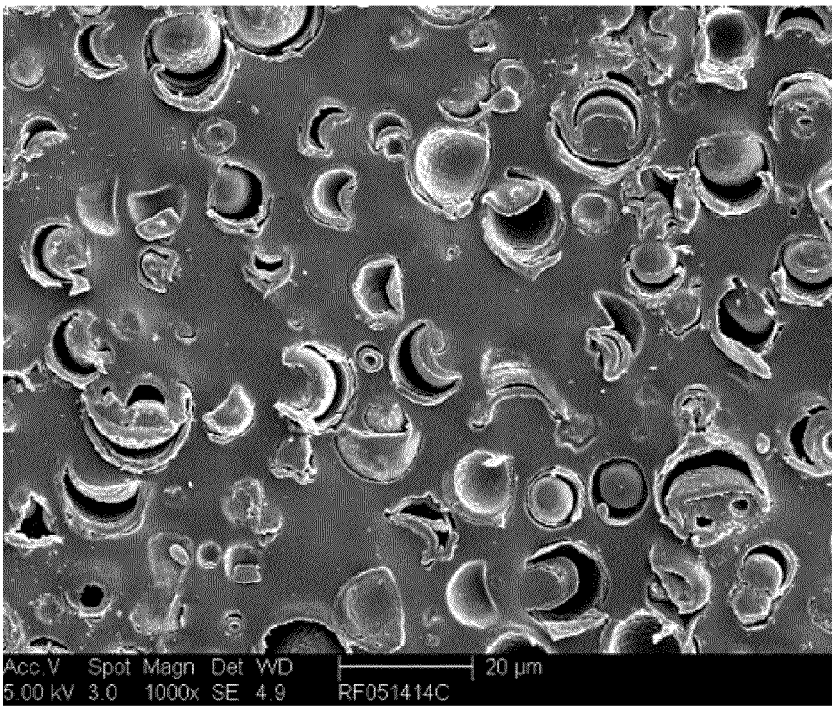
FIG. 3A is a scanning electron microscope image at 1000× magnification of a polishing pad cross-section having broken and emptied liquid-filled porogens upon cutting of the polishing pad, in accordance with an embodiment of the present invention.
Figure 3B:
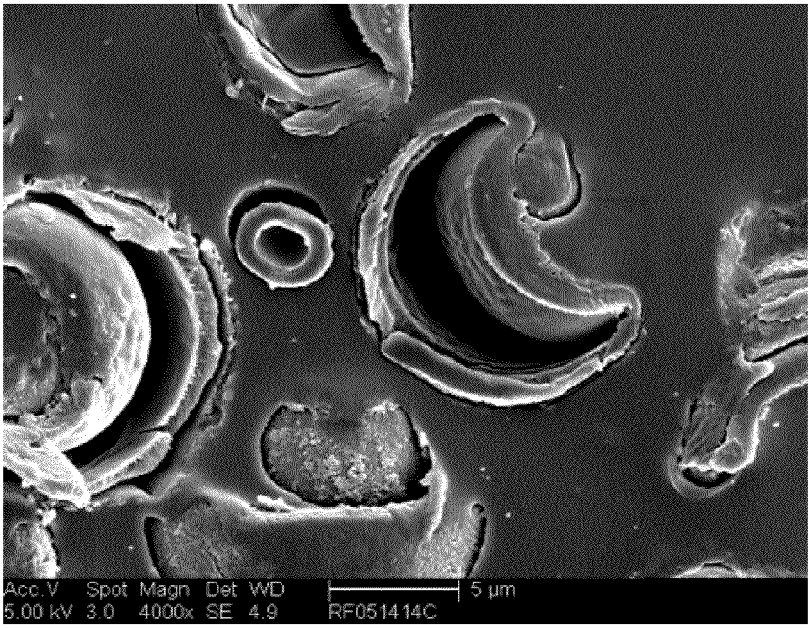
FIG. 3B is a scanning electron microscope image at 4000× magnification of a polishing pad cross-section having broken and emptied liquid-filled porogens upon cutting of the polishing pad, in accordance with an embodiment of the present invention.

As an example of a polishing cross-section that is representative of surface 110 generated upon breaking of liquid-filled porogens, FIGS. 3A and 3B are scanning electron microscope images of a polishing pad 300 cross-section having broken and emptied liquid-filled porogens upon cutting of the polishing pad, in accordance with an embodiment of the present invention. FIG. 3A is magnified 1000×, while FIG. 3B shows magnification at 4000×. In both images, broken, crescent-shaped porogens can be seen. The porogens have an average diameter of 12 microns and a density of 40%.

In another aspect, polishing pads having liquid-filled porogens may be fabricated in a molding process. For example, FIGS. 4A-4D illustrate cross-sectional views of operations used in the fabrication of a polishing pad, in accordance with an embodiment of the present invention.

Figure 4A:
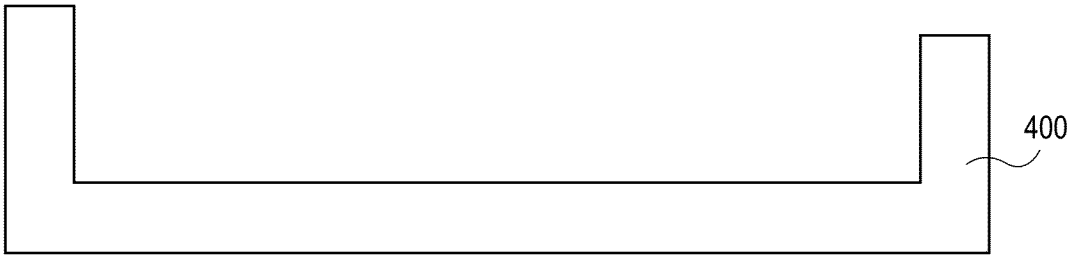
FIGS. 4A-4D illustrate cross-sectional views of operations used in the fabrication of a polishing pad having porogens with liquid filler, in accordance with an embodiment of the present invention.
Figure 4B:
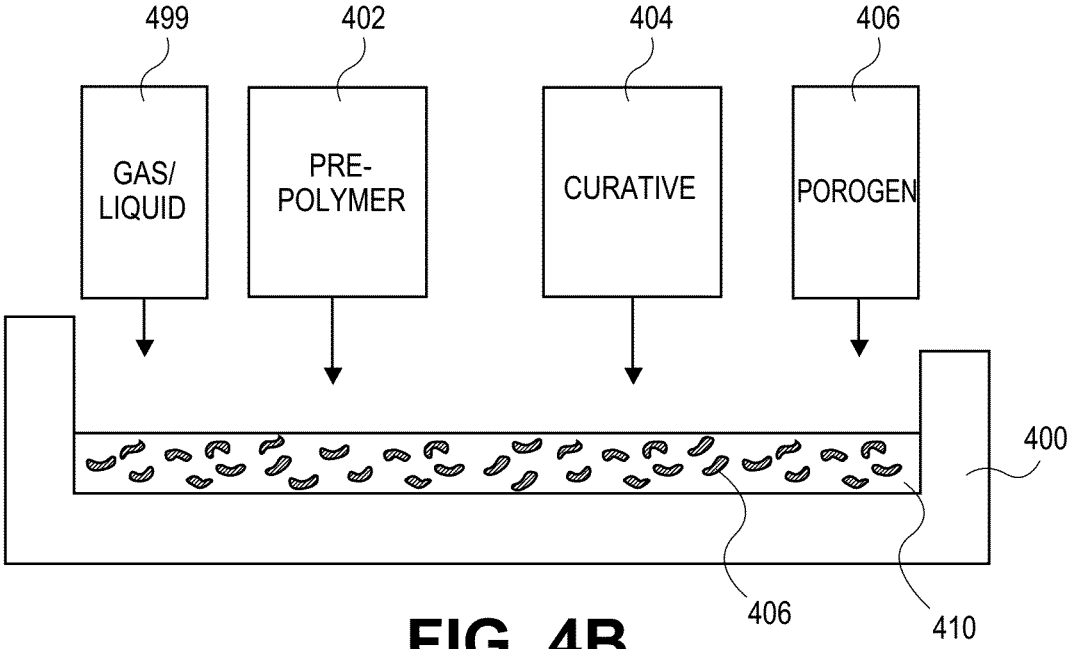

Referring to FIG. 4A, a formation mold 400 is provided. Referring to FIG. 4B, a pre-polymer 402 and a curative 404 (e.g., a chain extender or cross-linker) are mixed with a plurality of porogens 406, such as the liquid-filled porogens 104 described above, to form a mixture 410 having the porogens 406 dispersed therein.

Figure 4C:
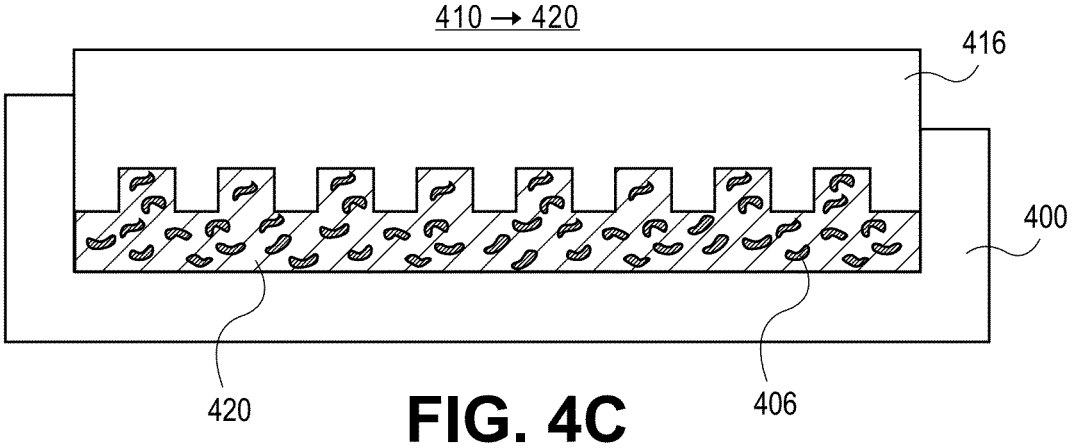

Referring to FIG. 4C, a lid 416 of the formation mold 400 is brought together with the base of the formation mold 400 and the mixture 410 takes the shape of the formation mold 400. In an embodiment, the mold 400 is degassed upon or during bringing together of the lid 416 and base of the formation mold 400 such that no cavities or voids form within the formation mold 410. It is to be appreciated that embodiments described herein that describe lowering the lid of a formation mold need only achieve a bringing together of the lid and a base of the formation mold. That is, in some embodiments, a base of a formation mold is raised toward a lid of a formation mold, while in other embodiments a lid of a formation mold is lowered toward a base of the formation mold at the same time as the base is raised toward the lid.

Referring again to FIG. 4C, the mixture 410 is cured in the formation mold 400. As an example, heating may be used to cure the mixture 410 to provide a partially or fully cured pad material 420 surrounding the liquid-filled porogens 406. In one such embodiment, the curing forms a cross-linked matrix based on the materials of the pre-polymer and the curative.

In an embodiment, the curing does not substantially expand each of the plurality of porogens 406. In an embodiment, substantial expansion of each of the plurality of porogens 406 would be greater than 50% increase in size by volume. For example, expansion of unexpanded EXPANCEL™ can be as much as 1000% to 4000% by volume.

Accordingly, in an embodiment, an unexpanded porogen 406 essentially does not expand during curing. If there is any expansion at all, in one embodiment, the expansion is less than 50% by volume.

In one embodiment, curing the mixture 410 involves heating the mixture 410, but to a temperature less than an expansion temperature of the plurality of liquid-filled porogens 406. In one embodiment, each of the plurality of porogens 406 has a collapsed-sphere shape, and the curing does not substantially modify the collapsed-sphere shape of each of the plurality of porogens 406. In one embodiment, each of the plurality of porogens 406 has an average diameter approximately in the range of 6-40 microns, and the curing does not substantially increase the average diameter of each of the plurality of porogens 406. In one embodiment, each of the plurality of porogens 406 has an initial shell thickness, and the curing does not substantially decrease the shell thickness of each of the plurality of porogens 406.

Figure 4D:
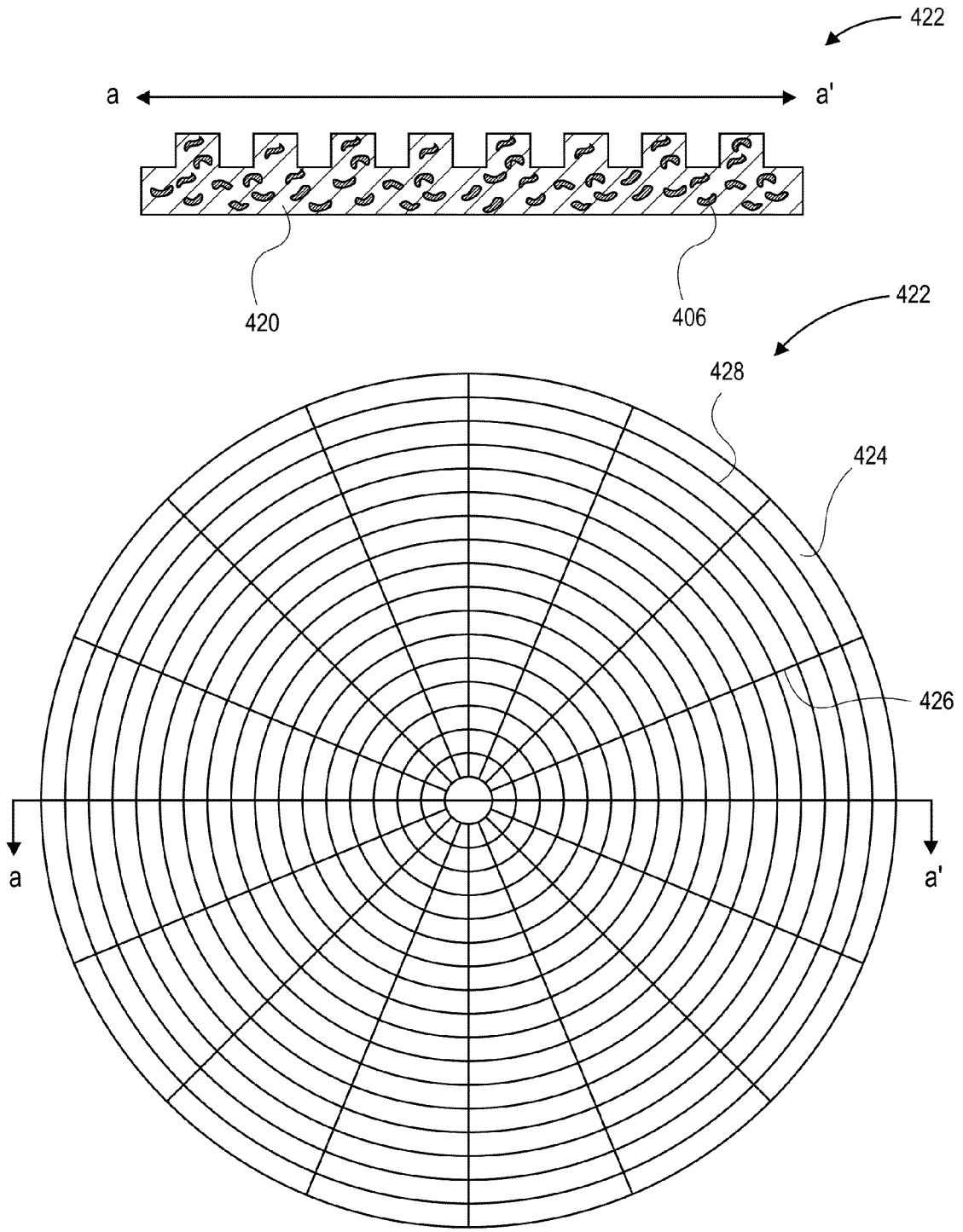

Referring to FIG. 4D, in an embodiment, the above described process is used to provide a polishing pad 420. The polishing pad 422 is composed of the cured material 420 and includes the liquid-filled porogens 406. In an embodiment, the polishing pad 422 is composed of a thermoset polyurethane material and the liquid-filled porogens 406 are dispersed in the thermoset polyurethane material. Referring again to FIG. 4D, the bottom portion of the figure is the plan view of the upper cross-sectional view which is taken along the a-a' axis. As seen in the plan view, in an embodiment, the polishing pad 422 has a polishing surface 428 having a groove pattern therein. In one particular embodiment, as shown, the groove pattern includes radial grooves 426 and concentric circular grooves 428.

In an embodiment, as mentioned as a possibility above, the mixture 410 is only partially cured in the mold 400 and, in one embodiment, is further cured in an oven subsequent to removal from the formation mold 420. However, in that embodiment, the heating does not substantially expand each of the plurality of porogens 406.

In an embodiment, the pre-polymer 402 is an isocyanate and the curative 404 is an aromatic diamine compound, and the polishing pad 422 is composed of a thermoset polyurethane material 220. In one such embodiment, forming mixture 410 further involves adding an opacifying filler to the pre-polymer 402 and the curative 404 to ultimately provide an opaque molded polishing body 422. In a specific such embodiment, the opacifying filler is a material such as, but not limited to, boron nitride, cerium fluoride, graphite, graphite fluoride, molybdenum sulfide, niobium sulfide, talc, tantalum sulfide, tungsten disulfide, or Teflon.

In an embodiment, the polishing pad precursor mixture 410 is used to ultimately form a molded homogeneous polishing body 422 composed of a thermoset polyurethane material. In one such embodiment, the polishing pad precursor mixture 410 is used to ultimately form a hard pad and only a single type of curative 404 is used. In another embodiment, however, the polishing pad precursor mixture 410 is used to ultimately form a soft pad and a combination of a primary and a secondary curative (together providing 404) is used. For example, in a specific embodiment, the pre-polymer 402 includes a polyurethane precursor, the primary curative includes an aromatic diamine compound, and the secondary curative includes an ether linkage. In a particular embodiment, the polyurethane precursor is an isocyanate, the primary curative is an aromatic diamine, and the secondary curative is a curative such as, but not limited to, polytetramethylene glycol, amino-functionalized glycol, or amino-functionalized polyoxypropylene. In an embodiment, a pre-polymer 402, a primary curative, and a secondary curative (together 404) have an approximate molar ratio of 106 parts pre-polymer, 85 parts primary curative, and 15 parts secondary curative, i.e., to provide a stoichiometry of approximately 1:0.96 pre-polymer:curative. It is to be appreciated that variations of the ratio may be used to provide polishing pads with varying hardness values, or based on the specific nature of the pre-polymer and the first and second curatives.

Referring again to FIG. 4D, as described above, in an embodiment, curing in the formation mold 400 involves forming a groove pattern in the polishing surface 424 of the molded polishing body 422. The groove pattern as shown includes radial grooves and concentric circular circumferential grooves. It is to be appreciated that radial grooves or circumferential grooves may be omitted. Furthermore, the concentric circumferential grooves may instead be polygons, such as nested triangles, squares, pentagons, hexagons, etc. Alternatively, the polishing surface may instead be based on protrusions instead of grooves. Furthermore, a polishing pad may be fabricated without grooves in the polishing surface. In one such example, a non-patterned lid of a molding apparatus is used instead of a patterned lid. Or, alternatively, the use of a lid during molding may be omitted. In the case of the use of a lid during molding, however, the mixture 410 may be heated under a pressure approximately in the range of 2-12 pounds per square inch.

Although several examples above refer to the fabrication of high density pads, polishing pads with liquid-filled porogens may be fabricated to include additional porosity and, thus, reduced density. For example, in an embodiment, in addition to a plurality of liquid-filled porogens, a polishing pad further includes a second plurality of porogens dispersed throughout the polymer matrix. The second plurality of porogens may be added as an additional component to forming the mixture 410 described in association with FIG. 4B. In one embodiment, each of the second plurality of porogens is composed of a shell and a gas filler (e.g., a majority of the mass of the filler is in the gas phase). In a specific such embodiment, the plurality of liquid-filled porogens amounts to between 10 and 40 weight % of the polishing pad, and the second plurality of porogens amounts to less than approximately 5 weight % of the polishing pad.

Figure 5:
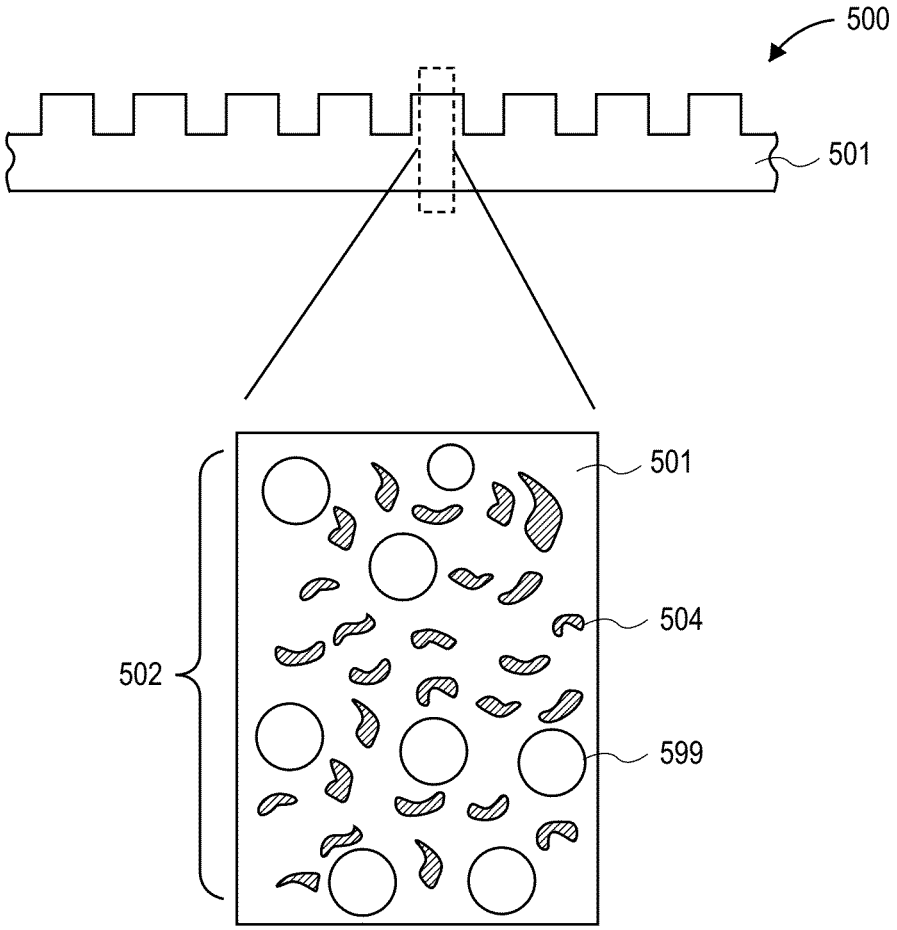
FIG. 5 illustrates a cross-sectional view of a CMP polishing pad having liquid-filled porogens and gas-filled porogens, in accordance with an embodiment of the present invention.

As an example, FIG. 5 illustrates a cross-sectional view of a CMP polishing pad having liquid-filled porogens and gas-filled porogens, in accordance with an embodiment of the present invention. Referring to FIG. 5, a polishing pad 500 includes a homogeneous polishing body 501. In one embodiment, the homogeneous polishing body 501 is composed of a thermoset polyurethane material 502 with a plurality of liquid-filled porogens 504 dispersed therein. Additionally, a plurality of gas-filled porogens 599 are also dispersed in the thermoset polyurethane material 502.

In an embodiment, each of the second plurality of microelements 599 is composed of pre-expanded and gas-filled EXPANCEL™ distributed throughout (e.g., as an additional component in) the polishing pad. That is, any significant expansion that could occur for the microelements 599 is carried our prior to their inclusion in a polishing pad formation, e.g., before being included in mixture 410. In a specific embodiment, the pre-expanded EXPANCEL™ is filled with pentane, a majority of which is in the gas phase.

In another embodiment, in addition to a plurality of liquid-filled porogens, a polishing pad further includes a plurality of shell-less porogens dispersed throughout the polymer matrix. The plurality of shell-less porogens may have a gas filler and may be formed as an additional component during or after forming the mixture 410 described in association with FIG.

4B. In one such embodiment, the mixing described in association with FIG. 4B further involves injecting a gas 499 into the pre-polymer and the curative, or into a product formed there from. In another embodiment, the pre-polymer is an isocyanate and the mixing further involves adding a liquid such as water to the pre-polymer to cause a reaction that leads to gas bubble formation in the final cured product.

In another aspect, a distribution of liquid-filled porogen average diameters in a polishing pad can have a bell curve or mono-modal distribution. The mono-modal distribution may be relatively broad or may be narrow, but is mono-modal, nonetheless. That is, for either a narrow distribution or a broad distribution, only one maximum average diameter population of liquid-filled porogens is provided in the polishing pad. Alternatively, a high density polishing pad may instead be fabricated with a bimodal distribution of porogen average diameters. As an example, FIG. 6A illustrates a cross-sectional view of a high density polishing pad having an approximately 1:1 bimodal distribution of liquid-filled porogens, in accordance with an embodiment of the present invention.

Figure 6A:
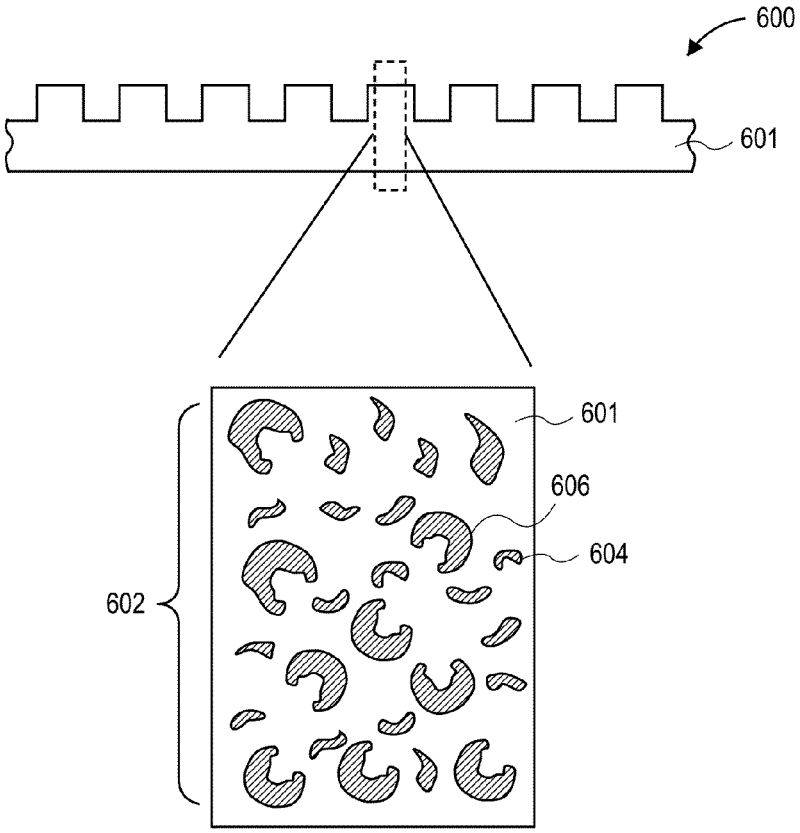
FIG. 6A illustrates a cross-sectional view of a high density polishing pad having an approximately 1:1 bimodal distribution of liquid-filled porogens, in accordance with an embodiment of the present invention.

Referring to FIG. 6A, a polishing pad 600 includes a homogeneous polishing body 601. In one embodiment, the homogeneous polishing body 601 is composed of a thermoset polyurethane material with a plurality of liquid-filled porogens 602 disposed in the homogeneous polishing body 601. The plurality of liquid-filled porogens 602 has a multi-modal distribution of average diameters. In an embodiment, the multi-modal distribution of average diameters is a bimodal distribution of average diameters including a small average diameter mode 604 and a large average diameter mode 606, as is depicted in FIG. 6A.

In an embodiment, the plurality of liquid-filled porogens 602 includes porogens that are discrete from one another, as is depicted in FIG. 6A. This is in contrast to open cell pores which may be connected to one another through tunnels, such as the case for the pores in a common sponge. In one embodiment, each of the liquid-filled porogens includes a physical shell, such as a polymeric shell. In an embodiment, the plurality of liquid-filled porogens 602, and hence the multi-modal distribution of average diameters, is distributed essentially evenly and uniformly throughout the thermoset polyurethane material of homogeneous polishing body 601, as is depicted in FIG. 6A.

Figure 6B:
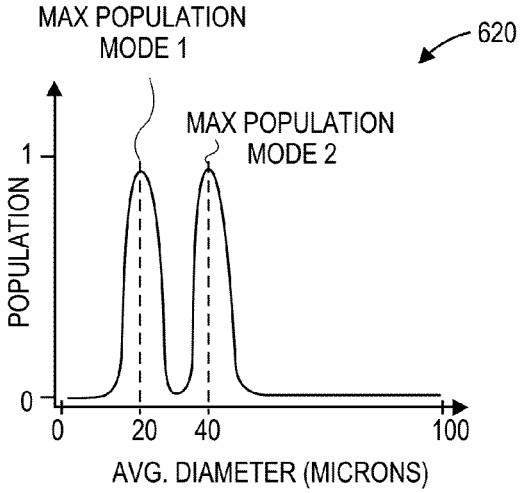
FIG. 6B illustrates a plot of population as a function of pore diameter for a narrow distribution of pore diameters in the polishing pad of FIG. 6A, in accordance with an embodiment of the present invention.
Figure 6C:
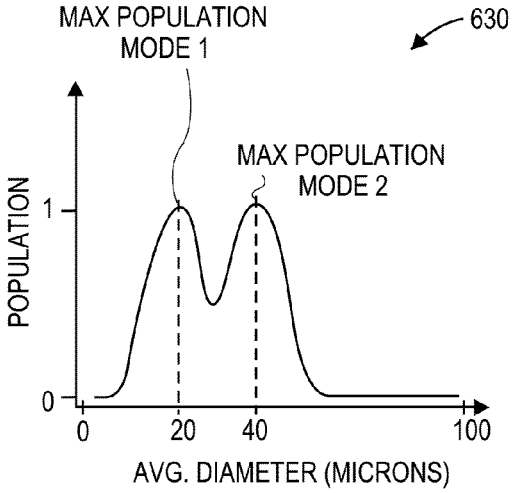
FIG. 6C illustrates a plot of population as a function of pore diameter for a broad distribution of pore diameters in the polishing pad of FIG. 6A, in accordance with an embodiment of the present invention.

In an embodiment, the bimodal distribution of porogen average diameters of the plurality of liquid-filled porogens 602 may be approximately 1:1, as is depicted in FIG. 6A. To better illustrate the concept, FIG. 6B illustrates a plot 620 of population as a function of porogen average diameter for a narrow distribution of porogen average diameters in the polishing pad of FIG. 6A, in accordance with an embodiment of the present invention. FIG. 6C illustrates a plot 630 of population as a function of porogen average diameter for a broad distribution of pore diameters in the polishing pad of FIG. 6A, in accordance with an embodiment of the present invention.

Referring to plot 620 of FIG. 6B, in one embodiment, the distribution of porogen average diameters is narrow. In a specific embodiment, the population of the large average diameter mode 606 has essentially no overlap with the population of the small average diameter mode 604. However, referring to plot 630 of FIG. 6C, in another embodiment, the distribution of porogen average diameters is broad. In a specific embodiment, the population of the large average diameter mode 606 overlaps with the population of the small average diameter mode 604. It is to be appreciated that a bimodal distribution of porogen average diameters need not be 1:1, as is described above in association with FIGS. 6A-6C. Also, a bimodal distribution of porogen average diameters need not be uniform. For example, in one embodiment, the multi-modal distribution of average diameters of liquid-filled porogens is graded throughout the thermoset polyurethane material with a gradient from the first, grooved surface to the second, flat surface. In a specific such embodiment, the graded multi-modal distribution of average diameters is a bimodal distribution of average diameters including a small average diameter mode proximate to the first, grooved surface, and a large average diameter mode proximate to the second, flat surface.

In an embodiment, polishing pads described herein, such as polishing pad 100, 200A, 200B, 300, 422, 500 or 600, or the above described variations thereof, are suitable for polishing substrates. The substrate may be one used in the semiconductor manufacturing industry, such as a silicon substrate having device or other layers disposed thereon. However, the substrate may be one such as, but not limited to, a substrates for MEMS devices, reticles, or solar modules. Thus, reference to "a polishing pad for polishing a substrate," as used herein, is intended to encompass these and related possibilities.

Polishing pads described herein, such as polishing pad 100, 200A, 200B, 300, 422, 500 or 600, or the above described variations thereof, may be composed of a homogeneous polishing body of a thermoset polyurethane material. In an embodiment, the homogeneous polishing body is composed of a thermoset polyurethane material. In an embodiment, the term "homogeneous" is used to indicate that the composition of a thermoset polyurethane material is consistent throughout the entire composition of the polishing body, regardless of the porogen distribution. For example, in an embodiment, the term "homogeneous" excludes polishing pads composed of, e.g., impregnated felt or a composition (composite) of multiple layers of differing material. In an embodiment, the term "thermoset" is used to indicate a polymer material that irreversibly cures, e.g., the precursor to the material changes irreversibly into an infusible, insoluble polymer network by curing. For example, in an embodiment, the term "thermoset" excludes polishing pads composed of, e.g., "thermoplast" materials or "thermoplastics"—those materials composed of a polymer that turns to a liquid when heated and returns to a very glassy state when cooled sufficiently. It is noted that polishing pads made from thermoset materials are typically fabricated from lower molecular weight precursors reacting to form a polymer in a chemical reaction, while pads made from thermoplastic materials are typically fabricated by heating a pre-existing polymer to cause a phase change so that a polishing pad is formed in a physical process. Polyurethane thermoset polymers may be selected for fabricating polishing pads described herein based on their stable thermal and mechanical properties, resistance to the chemical environment, and tendency for wear resistance.

In an embodiment, the homogeneous polishing body, upon conditioning and/or polishing, has a polishing surface roughness approximately in the range of 1-5 microns root mean square. In one embodiment, the homogeneous polishing body, upon conditioning and/or polishing, has a polishing surface roughness of approximately 2.35 microns root mean square. In an embodiment, the homogeneous polishing body has a storage modulus at 25 degrees Celsius approximately in the range of 30-120 megaPascals (MPa). In another embodiment, the homogeneous polishing body has a storage modulus at 25 degrees Celsius approximately less than 30 megaPascals (MPa). In one embodiment, the homogeneous polishing body has a compressibility of approximately 2.5%.

In an embodiment, polishing pads described herein, such as polishing pad 100, 200A, 200B, 300, 422, 500 or 600, or the above described variations thereof, include a molded homogeneous polishing body. The term "molded" is used to indicate that a homogeneous polishing body is formed in a formation mold, as described in more detail above in association with FIGS. 4A-4D. It is to be understood that, in other embodiments, a casting process may be used instead to fabricate polishing pads such as those described above.

In an embodiment, the homogeneous polishing body is opaque. In one embodiment, the term "opaque" is used to indicate a material that allows approximately 10% or less visible light to pass. In one embodiment, the homogeneous polishing body is opaque in most part, or due entirely to, the inclusion of an opacifying filler throughout (e.g., as an additional component in) the homogeneous thermoset polyurethane material of the homogeneous polishing body. In a specific embodiment, the opacifying filler is a material such as, but not limited to, boron nitride, cerium fluoride, graphite, graphite fluoride, molybdenum sulfide, niobium sulfide, talc, tantalum sulfide, tungsten disulfide, or Teflon.

The sizing of the polishing pads, such as pads 100, 200A, 200B, 300, 422, 500 or 600, may be varied according to application. Nonetheless, certain parameters may be used to fabricate polishing pads compatible with conventional processing equipment or even with conventional chemical mechanical processing operations. For example, in accordance with an embodiment of the present invention, a polishing pad has a thickness approximately in the range of 0.075 inches to 0.130 inches, e.g., approximately in the range of 1.9-3.3 millimeters. In one embodiment, a polishing pad has a diameter approximately in the range of 20 inches to 30.3 inches, e.g., approximately in the range of 50-77 centimeters, and possibly approximately in the range of 10 inches to 42 inches, e.g., approximately in the range of 25-107 centimeters.

In another embodiment of the present invention, a polishing pad described herein further includes a local area transparency (LAT) region disposed in the polishing pad. In an embodiment, the LAT region is disposed in, and covalently bonded with, the polishing pad. Examples of suitable LAT regions are described in U.S. patent application Ser. No. 12/657,135 filed on Jan. 13, 2010, assigned to NexPlanar Corporation, and U.S. patent application Ser. No. 12/895,465 filed on Sep. 30, 2010, assigned to NexPlanar Corporation.

In an alternative or additional embodiment, a polishing pad further includes an aperture disposed in the polishing surface and polishing body. The aperture can accommodate, e.g., a detection device included in a platen of a polishing tool. An adhesive sheet is disposed on the back surface of the polishing body. The adhesive sheet provides an impermeable seal for the aperture at the back surface of the polishing body. Examples of suitable apertures are described in U.S. patent application Ser. No. 13/184,395 filed on Jul. 15, 2011, assigned to NexPlanar Corporation.

In another embodiment, a polishing pad further includes a detection region for use with, e.g., an eddy current detection system. Examples of suitable eddy current detection regions are described in U.S. patent application Ser. No. 12/895,465 filed on Sep. 30, 2010, assigned to NexPlanar Corporation.

Polishing pads described herein, such as polishing pad 100, 200A, 200B, 300, 422, 500 or 600, or the above described variations thereof, may further include a foundation layer disposed on the back surface of the polishing body. In one such embodiment, the result is a polishing pad with bulk or foundation material different from the material of the polishing surface. In one embodiment, a composite polishing pad includes a foundation or bulk layer fabricated from a stable, essentially non-compressible, inert material onto which a polishing surface layer is disposed. A harder foundation layer may provide support and strength for pad integrity while a softer polishing surface layer may reduce scratching, enabling decoupling of the material properties of the polishing layer and the remainder of the polishing pad. Examples of suitable foundation layers are described in U.S. patent application Ser. No. 13/306,845 filed on Nov. 29, 2011, assigned to NexPlanar Corporation.

Polishing pads described herein, such as polishing pad 100, 200A, 200B, 300, 422, 500 or 600, or the above described variations thereof, may further include a sub pad disposed on the back surface of the polishing body, e.g., a conventional sub pad as known in the CMP art. In one such embodiment, the sub pad is composed of a material such as, but not limited to, foam, rubber, fiber, felt or a highly porous material.

Referring again to FIG. 4D as a foundation for description, individual grooves of a groove pattern formed in a polishing pad such as those described herein may be from about 4 to about 100 mils deep at any given point on each groove. In some embodiments, the grooves are about 10 to about 50 mils deep at any given point on each groove. The grooves may be of uniform depth, variable depth, or any combinations thereof. In some embodiments, the grooves are all of uniform depth. For example, the grooves of a groove pattern may all have the same depth. In some embodiments, some of the grooves of a groove pattern may have a certain uniform depth while other grooves of the same pattern may have a different uniform depth. For example, groove depth may increase with increasing distance from the center of the polishing pad. In some embodiments, however, groove depth decreases with increasing distance from the center of the polishing pad. In some embodiments, grooves of uniform depth alternate with grooves of variable depth.

Individual grooves of a groove pattern formed in a polishing pad such as those described herein may be from about 2 to about 100 mils wide at any given point on each groove. In some embodiments, the grooves are about 15 to about 50 mils wide at any given point on each groove. The grooves may be of uniform width, variable width, or any combinations thereof. In some embodiments, the grooves of are all of uniform width. In some embodiments, however, some of the grooves of a concentric have a certain uniform width, while other grooves of the same pattern have a different uniform width. In some embodiments, groove width increases with increasing distance from the center of the polishing pad. In some embodiments, groove width decreases with increasing distance from the center of the polishing pad. In some embodiments, grooves of uniform width alternate with grooves of variable width.

In accordance with the previously described depth and width dimensions, individual grooves of the groove patterns described herein, including grooves at or near a location of an aperture in a polishing pad, may be of uniform volume, variable volume, or any combinations thereof. In some embodiments, the grooves are all of uniform volume. In some embodiments, however, groove volume increases with increasing distance from the center of the polishing pad. In some other embodiments, groove volume decreases with increasing distance from the center of the polishing pad. In some embodiments, grooves of uniform volume alternate with grooves of variable volume.

Grooves of the groove patterns described herein may have a pitch from about 30 to about 1000 mils. In some embodiments, the grooves have a pitch of about 125 mils. For a circular polishing pad, groove pitch is measured along the radius of the circular polishing pad. In CMP belts, groove pitch is measured from the center of the CMP belt to an edge of the CMP belt. The grooves may be of uniform pitch, variable pitch, or in any combinations thereof. In some embodiments, the grooves are all of uniform pitch. In some embodiments, however, groove pitch increases with increasing distance from the center of the polishing pad. In some other embodiments, groove pitch decreases with increasing distance from the center of the polishing pad. In some embodiments, the pitch of the grooves in one sector varies with increasing distance from the center of the polishing pad while the pitch of the grooves in an adjacent sector remains uniform. In some embodiments, the pitch of the grooves in one sector increases with increasing distance from the center of the polishing pad while the pitch of the grooves in an adjacent sector increases at a different rate. In some embodiments, the pitch of the grooves in one sector increases with increasing distance from the center of the polishing pad while the pitch of the grooves in an adjacent sector decreases with increasing distance from the center of the polishing pad. In some embodiments, grooves of uniform pitch alternate with grooves of variable pitch. In some embodiments, sectors of grooves of uniform pitch alternate with sectors of grooves of variable pitch.

Polishing pads described herein may be suitable for use with a variety of chemical mechanical polishing apparatuses. As an example, FIG. 7 illustrates an isometric side-on view of a polishing apparatus compatible with a polishing pad, in accordance with an embodiment of the present invention.

Figure 7:
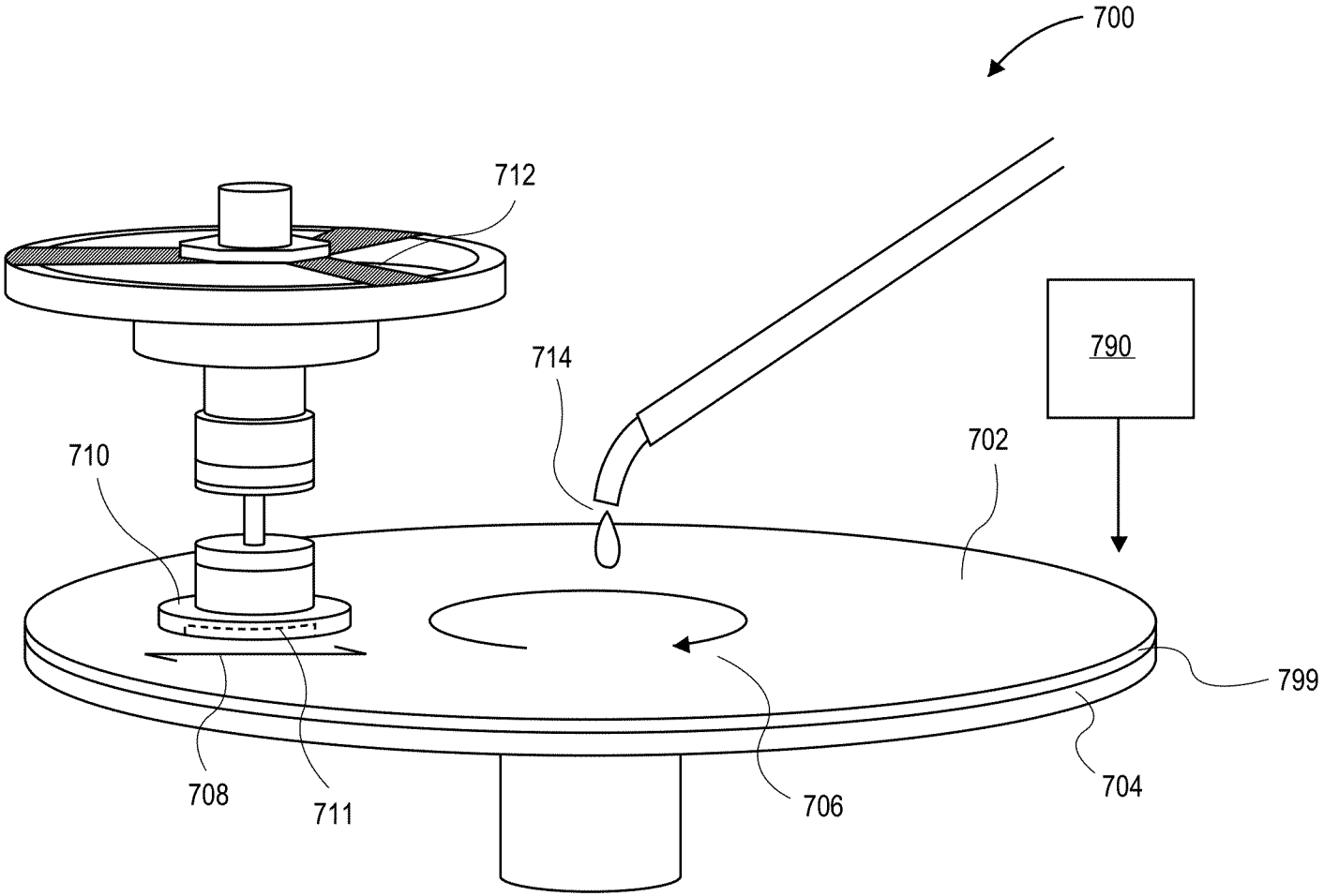
FIG. 7 illustrates an isometric side-on view of a polishing apparatus compatible with a polishing pad having porogens with liquid filler, in accordance with an embodiment of the present invention.

Referring to FIG. 7, a polishing apparatus 700 includes a platen 704. The top surface 702 of platen 704 may be used to support a polishing pad 799, such as polishing pad 100, 200A, 200B, 300, 422, 500 or 600, or variations thereof as described above. Platen 704 may be configured to provide spindle rotation 706 and slider oscillation 708. A sample carrier 710 is used to hold, e.g., a semiconductor wafer 711 in place during polishing of the semiconductor wafer with a polishing pad. Sample carrier 710 is further supported by a suspension mechanism 712. A slurry feed 714 is included for providing slurry to a surface of the polishing pad 799 prior to and during polishing of the semiconductor wafer. A conditioning unit 790 may also be included and, in one embodiment, includes a diamond tip for conditioning the polishing pad 799. In an embodiment, as described in association with FIG. 1C, the conditioning unit 790 is used to open liquid-filled porogens of the polishing pad 799.

Thus, polishing pads having porogens with liquid filler and methods of fabricating polishing pads having porogens with liquid filler have been disclosed. In accordance with an embodiment of the present invention, a polishing pad for polishing a substrate includes a polishing body having a polymer matrix and a plurality of porogens dispersed throughout the polymer matrix. Each of the plurality of porogens has a shell with a liquid filler. The liquid filler has a boiling point less than 100 degrees Celsius at a pressure of 1 atm, a density less than water, or both.

What is claimed is:

1. A polishing pad for polishing a substrate, the polishing pad comprising:

a polishing body comprising a polymer matrix and a plurality of porogens dispersed throughout the polymer matrix, each of the plurality of porogens comprising a shell with a liquid filler, the liquid filler having a boiling point less than 100 degrees Celsius at a pressure of 1 atm.

2. The polishing pad of claim 1, wherein the shell of each of the plurality of porogens is a polymeric shell, and wherein the liquid filler is selected from the group consisting of n-pentane, iso-pentane, butane, and iso-butane.

3. The polishing pad of claim 2, wherein the polymeric shell comprises a material selected from the group consisting of a block-co-polymer, polyvinylidine chloride, an acrylic material, and acrylonitrile.

4. The polishing pad of claim 1, wherein the polymer matrix of the polishing body comprises a thermoset polyurethane material.

5. The polishing pad of claim 1, wherein at least some of the plurality of porogens have a collapsed-sphere shape.

6. The polishing pad of claim 4, wherein the collapsed-sphere shape has an average diameter approximately in the range of 6-40 microns.

7. The polishing pad of claim 1, wherein the polishing body including the polymer matrix and the plurality of porogens has a total volume, and wherein the plurality of porogens comprises approximately 20% to approximately 50% of the total volume.

8. The polishing pad of claim 1, wherein the polishing body including the polymer matrix and the plurality of porogens has a total density greater than approximately 0.8 g/cm$^3$.

9. The polishing pad of claim 7, wherein the polishing body including the polymer matrix and the plurality of porogens has a total density greater than approximately 1 g/cm$^3$.

10. The polishing pad of claim 1, wherein the plurality of porogens has a multi-modal volume distribution.

11. The polishing pad of claim 10, wherein the multi-modal volume distribution is a graded distribution.

12. The polishing pad of claim 1, further comprising:

a second plurality of porogens dispersed throughout the polymer matrix, each of the second plurality of porogens comprising a shell with a gas filler.

13. The polishing pad of claim 12, wherein the plurality of porogens amounts to between 10 and 40 weight % of the polishing pad, and wherein the second plurality of porogens amounts to less than approximately 5 weight % of the polishing pad.

14. The polishing pad of claim 1, further comprising:

a second plurality of porogens dispersed throughout the polymer matrix, wherein each of the second plurality of porogens is a shell-less porogen with a gas filler.

15. The polishing pad of claim 1, wherein the liquid filler of each of the plurality of porogens has a boiling point less than 40 degrees Celsius at a pressure of 1 atm.

16. The polishing pad of claim 1, wherein the polishing body further comprises:

a first, grooved surface; and a second, flat surface opposite the first surface.

17. The polishing pad of claim 1, wherein the polishing body is a molded polishing body.

18. The polishing pad of claim 1, further comprising:

an opacifying filler distributed approximately evenly throughout the polishing body.

19. The polishing pad of claim 1, further comprising:

a foundation layer disposed on a back surface of the polishing body.

20. The polishing pad of claim 1, further comprising:

a detection region disposed in a back surface of the polishing body.

21. The polishing pad of claim 1, further comprising:

a sub pad disposed on a back surface of the polishing body.

22. The polishing pad of claim 1, further comprising:

a local area transparency (LAT) region disposed in the polishing body.

23. A polishing pad for polishing a substrate, the polishing pad comprising:

a polishing body comprising a polymer matrix and a plurality of porogens dispersed throughout the polymer matrix, each of the plurality of porogens comprising a shell with a liquid filler, the liquid filler having a density less than water.

24. The polishing pad of claim 23, wherein the liquid filler has a density less than approximately 0.7 g/cm$^3$.

25. The polishing pad of claim 23, wherein the shell of each of the plurality of porogens is a polymeric shell, and wherein the liquid filler is a hydrocarbon molecule having seven or more carbon atoms.

26. The polishing pad of claim 25, wherein the polymeric shell comprises a material selected from the group consisting of a block-co-polymer, polyvinylidine chloride, an acrylic material, and acrylonitrile.

27. The polishing pad of claim 23, wherein the polymer matrix of the polishing body comprises a thermoset polyurethane material.

28. The polishing pad of claim 23, wherein at least some of the plurality of porogens have a collapsed-sphere shape.

29. The polishing pad of claim 28, wherein the collapsed-sphere shape has an average diameter approximately in the range of 6-40 microns.

30. The polishing pad of claim 23, wherein the polishing body including the polymer matrix and the plurality of porogens has a total volume, and wherein the plurality of porogens comprises approximately 20% to approximately 50% of the total volume.

31. The polishing pad of claim 23, wherein the polishing body including the polymer matrix and the plurality of porogens has a total density greater than approximately 0.8 g/cm$^3$.

32. The polishing pad of claim 31, wherein the polishing body including the polymer matrix and the plurality of porogens has a total density greater than approximately 1 g/cm$^3$.

33. The polishing pad of claim 23, wherein the plurality of porogens has a multi-modal volume distribution.

34. The polishing pad of claim 33, wherein the multi-modal volume distribution is a graded distribution.

35. The polishing pad of claim 23, further comprising:

a second plurality of porogens dispersed throughout the polymer matrix, each of the second plurality of porogens comprising a shell with a gas filler.

36. The polishing pad of claim 35, wherein the plurality of porogens amounts to between 10 and 40 weight % of the polishing pad, and wherein second plurality of porogens amounts to less than approximately 5 weight % of the polishing pad.

37. The polishing pad of claim 23, further comprising:

a second plurality of porogens dispersed throughout the polymer matrix, wherein each of the second plurality of porogens is a shell-less porogen with a gas filler.

38. The polishing pad of claim 23, wherein the liquid filler of each of the plurality of porogens has a boiling point less than 40 degrees Celsius at a pressure of 1 atm.

39. The polishing pad of claim 23, wherein the polishing body further comprises:

a first, grooved surface; and a second, flat surface opposite the first surface.

40. The polishing pad of claim 23, wherein the polishing body is a molded polishing body.

41. The polishing pad of claim 23, further comprising:

an opacifying filler distributed approximately evenly throughout the polishing body.

42. The polishing pad of claim 23, further comprising:

a foundation layer disposed on a back surface of the polishing body.

43. The polishing pad of claim 23, further comprising:

a detection region disposed in a back surface of the polishing body.

44. The polishing pad of claim 23, further comprising:

a sub pad disposed on a back surface of the polishing body.

45. The polishing pad of claim 23, further comprising:

a local area transparency (LAT) region disposed in the polishing body.

46. A method of fabricating a polishing pad, the method comprising:

mixing a pre-polymer and a curative with a plurality of porogens to form a mixture, each of the plurality of porogens comprising a shell with a liquid filler, the liquid filler having a boiling point less than 100 degrees Celsius at a pressure of 1 atm or having a density less than water, or both; and curing the mixture to provide a polishing pad comprising a polishing body having the plurality of porogens dispersed throughout a polymer matrix of the polishing body, wherein the curing does not substantially expand each of the plurality of porogens.

47. The method of claim 46, wherein curing the mixture to provide the polishing pad comprises curing the mixture in a formation mold to provide a molded polishing pad.

48. The method of claim 47, wherein curing in the formation mold comprises forming a groove pattern in a polishing surface of the polishing body.

49. The method of claim 46, wherein curing the mixture comprises heating the mixture to a temperature less than an expansion temperature of the plurality of porogens.

50. The method of claim 46, wherein curing the mixture forms a thermoset polyurethane polymer matrix of the polishing body.

51. The method of claim 50, wherein mixing the pre-polymer and the curative comprises mixing an isocyanate and an aromatic diamine compound, respectively.

52. The method of claim 46, wherein the mixing further comprises injecting a gas into the pre-polymer and the curative, or into a product formed there from.

53. The method of claim 46, wherein the pre-polymer is an isocyanate and the mixing further comprises adding water to the pre-polymer.

54. The method of claim 46, wherein the mixing further comprises mixing the pre-polymer, the curative and the plurality of porogens with a second plurality of porogens dispersed throughout the polymer matrix, each of the second plurality of porogens comprising a shell with a gas filler.

55. The method of claim 46, wherein each of the plurality of porogens has a collapsed-sphere shape, and wherein the curing does not substantially modify the collapsed-sphere shape of each of the plurality of porogens.

56. The method of claim 46, wherein each of the plurality of porogens has an average diameter approximately in the range of 6-40 microns, and wherein the curing does not substantially increase the average diameter of each of the plurality of porogens.

57. The method of claim 46, wherein the mixing further comprises adding an opacifying filler to the pre-polymer and the curative.

58. The method of claim 46, further comprising:

subsequent to the curing, heating the polishing pad in an oven, wherein the heating does not substantially expand each of the plurality of porogens.

59. A method of polishing a substrate, the method comprising:

providing a polishing pad on a platen, the polishing pad comprising a plurality of porogens dispersed throughout a polymer matrix of a polishing body of the polishing pad, each of the plurality of porogens comprising a shell with a liquid filler, the liquid filler having a boiling point less than 100 degrees Celsius at a pressure of 1 atm or having a density less than water, or both;

conditioning the polishing pad, the conditioning comprising breaking an uppermost portion of the plurality of porogens of the polishing body of the polishing pad to provide a polishing surface of the polishing pad;

applying a slurry on the polishing surface of the polishing pad; and polishing a substrate with the slurry on the polishing surface of the polishing pad.

60. The method of claim 59, wherein breaking the uppermost portion of the plurality of porogens comprises releasing at least a portion of the liquid filler of each of the uppermost portion of the plurality of porogens by volatilization of the liquid filler.

61. The method of claim 59, wherein applying the slurry on the polishing surface of the polishing pad comprises displacing at least a portion of the liquid filler from each of the uppermost portion of the plurality of porogens with the slurry.

62. The method of claim 59, wherein breaking the uppermost portion of the plurality of porogens comprises providing a plurality of pores at the polishing surface of the polishing pad.

63. The method of claim 62, wherein providing the plurality of pores at the polishing surface of the polishing pad provides an intrinsic ability of the polishing pad to transport slurry.

64. The method of claim 59, wherein breaking the uppermost portion of the plurality of porogens provides the polishing surface having a lower density and lower hardness than a remaining underlying portion of the polishing body of the polishing pad.

65. The method of claim 59, wherein breaking the uppermost portion of the plurality of porogens comprises cutting an uppermost portion of the polishing pad with a pad conditioning tool.

* * * * *